US009124058B2

(12) United States Patent
Conte et al.

(10) Patent No.: US 9,124,058 B2
(45) Date of Patent: Sep. 1, 2015

(54) FEEDING WIRE-ENDS TO PROCESSING UNITS

(75) Inventors: Alois Conte, Ebikon (CH); Stefan Viviroli, Horw (CH)

(73) Assignee: Komax Holding AG, Dierikon (CH)

( * ) Notice: Subject to any disclaimer, the term of this patent is extended or adjusted under 35 U.S.C. 154(b) by 460 days.

(21) Appl. No.: 13/596,368

(22) Filed: Aug. 28, 2012

(65) Prior Publication Data

US 2013/0048141 A1 Feb. 28, 2013

(30) Foreign Application Priority Data

Aug. 31, 2011 (EP) ..... 11179623

(51) Int. Cl.
*H01R 43/052* (2006.01)
*H01R 43/28* (2006.01)

(52) U.S. Cl.
CPC ..... *H01R 43/052* (2013.01); *H01R 43/28* (2013.01)

(58) Field of Classification Search
CPC ..... B21F 1/00; B21F 1/06; H01R 43/28; H01R 43/052
USPC ..... 140/102, 102.5
See application file for complete search history.

(56) References Cited

U.S. PATENT DOCUMENTS

| | | | | |
|---|---|---|---|---|
| 3,329,177 | A * | 7/1967 | Westbrook et al. | 140/89 |
| 4,852,249 | A | 8/1989 | Muskulus et al. | |
| 4,875,571 | A | 10/1989 | Kolodziej | |
| 5,159,749 | A * | 11/1992 | Weigert et al. | 29/742 |
| 5,632,086 | A * | 5/1997 | Helwig | 140/123 |
| 6,135,164 | A | 10/2000 | Celoudoux et al. | |

FOREIGN PATENT DOCUMENTS

| | | | |
|---|---|---|---|
| DE | 19844416 | A1 | 4/1999 |
| EP | 0271743 | A2 | 6/1988 |
| EP | 2088649 | A1 | 8/2009 |
| WO | 99/14829 | A1 | 3/1999 |

* cited by examiner

*Primary Examiner* — Teresa M Ekiert
(74) *Attorney, Agent, or Firm* — Fraser Clemens Martin & Miller LLC; William J. Clemens

(57) ABSTRACT

In a processing device the wire-ends are fed circularly to the peripherally arranged processing units. A loop-layer grasps a leading wire-end and lays it in a wire-loop. The wire is then advanced by a belt apparatus, and a loop-guide picks up a loop-end and moves upward until the wire-loop has attained the desired dimension and transfers the loop-end of the wire-loop to a holding element of a rotary star, which, by means of the loop-guide, is displaceable along a linear axle, depending on the length of the wire-loop.

12 Claims, 13 Drawing Sheets

FEEDING WIRE-ENDS TO PROCESSING UNITS

CROSS-REFERENCE TO RELATED APPLICATION

This application claims priority to European Patent Application No. 11179623.1, filed Aug. 31, 2011, which is incorporated herein by reference.

FIELD

The disclosure relates to feeding wire-ends of a wire-loop to one or more processing units.

BACKGROUND

In some cases, a wire processing system includes a wire unit, a wire feeder, and processing units. Foreseen as processing units are insulation-stripping stations, seal/sleeve stations, and/or crimp stations. Wires with different cross-sections, colors, and structures are held in a height-adjustable wire-changer. Through height-adjustment of the wire-changer, the type of wire that is to be processed is brought into a straightening path. The leading wire-end is grasped by a loop-layer and rotated horizontally through 180 degrees. Simultaneously, by means of a wire advancer, the wire is advanced, and by means of the straightening section, is straightened. An encoder measures the length of the advanced wire, whereby on advancement of the wire a wire-loop is formed. The wire-feeder consists of a first transfer unit, which is displaceable along a transfer guide, with a first gripper unit, and of a second transfer unit, which is displaceable along the transfer guide, with a second gripper unit. A first drive moves the first transfer unit along the transfer guide. A second drive moves the second transfer unit along the transfer guide. A control device controls and monitors the processing system, the movements particularly of the transfer units and of the gripper units being freely programmable.

A keyboard and a monitor serve as human/machine interface. The first gripper unit accepts the leading wire-end of the wire-loop from the loop-layer and the trailing wire-end of the wire-loop from the wire-changer. After the wire is cut, the first transfer unit moves to the insulation-stripping station, which removes the wire sheath from the wire-ends. After the insulation-stripping operation, the first transfer unit with the wire-loop moves further to a first transfer station, transfers the wire-loop to the latter, and returns to the starting position. At the transfer station, the second transfer unit accepts the wire-loop and brings the transfer unit to a seal/sleeve station and/or to at least one crimping station.

The linear displacement of the transfer units and the transfer of the wire-loop to the transfer station can be time-intensive and can make the wire-processing process slow. It is also not ruled out that the hanging wire-loops tangle while being transported.

SUMMARY

At least some of the disclosed embodiments comprise a device with a small standing area that is compactly dimensioned but nevertheless attains a high number of processed wire-ends per unit of time.

In particular embodiments in the case of relatively long wire-lengths, which are to be processed several times, thanks to the proposed device a high production performance or a high number of units per unit of time can be achieved, because the type of wire feed allows high transport speeds of the wire and short cycle times. Also possible is a parallel work process of the wire feeding and wire-end processing. A simple embodiment of the proposed device can be based on the principle of a cycled circular transfer or of a carousel. The wire that is fed as a wire-loop is held at one end at the ends by means of grippers or holding elements, for example on a cycled rotary plate, at the other end the wire-loop is held firmly outside the rotary plate by means of a further gripper, or further holding element, approximately centrally, or at the wire loop-end. This point above the rotary plate is usually provided with, for example, a rotary star. Cycle time and angular speed of the rotary plate and of the star are identical. The half wire-length is mainly determined by the distance of the rotary plate from the star. Since each wire-loop is hence held at three points, even with frequent rotation and feeding movements the loops do not mutually cross paths and can therefore also not become entangled. The processed wire-ends of the loops are possibly only released immediately before being transported out. A possible twist in the wire can therefore not result. The freely hanging individual loop is then transferred to a transporting-out device, In some cases, particularly also with longer wires, no tangling is possible, and sensitive contacts on the wire-ends are protectively treated.

In additional embodiments it is possible that, after the wire-loops have been processed, they can be removed from the machine in hung form. In particular, in this manner, long wire-loops can be easily transported further. In addition to the easier removal of the wire-loops, the accuracy of the processing of the wire-ends can be improved, because the wire-loop is protectively transported from processing station to processing station, The wire-loop is not, as in the state of the art, dragged away by the effect of tension forces on the wire-ends.

BRIEF DESCRIPTION OF THE DRAWINGS

The proposed device is explained in more detail by reference to the attached figures.

Shown are in.

DETAILED DESCRIPTION

Figure 1:
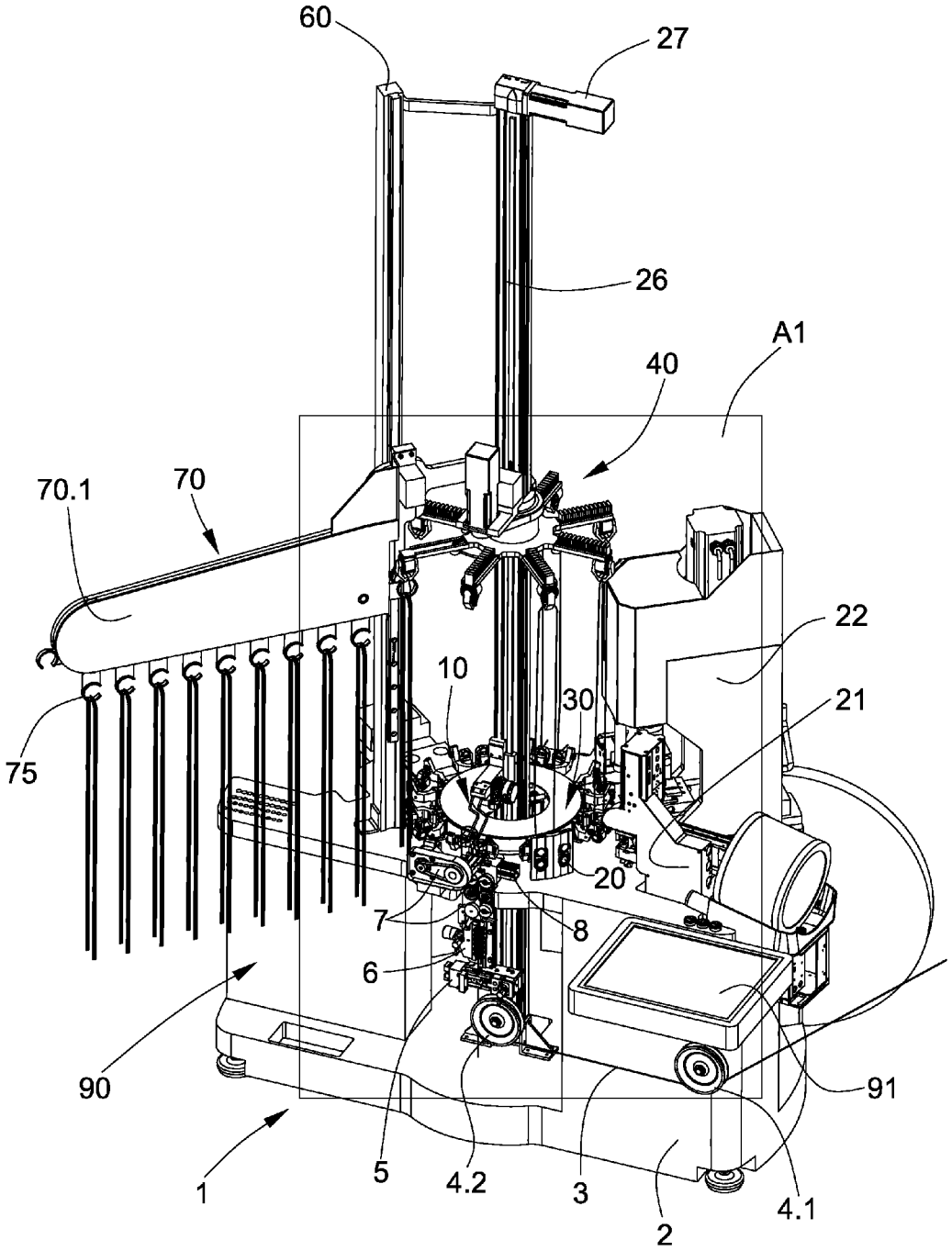
FIG. 1, a three-dimensional view of the side of an exemplary embodiment of the proposed device for feeding wire-ends to processing units, which functions on the principle of a rotating transfer or carousel.
Figure 1A:
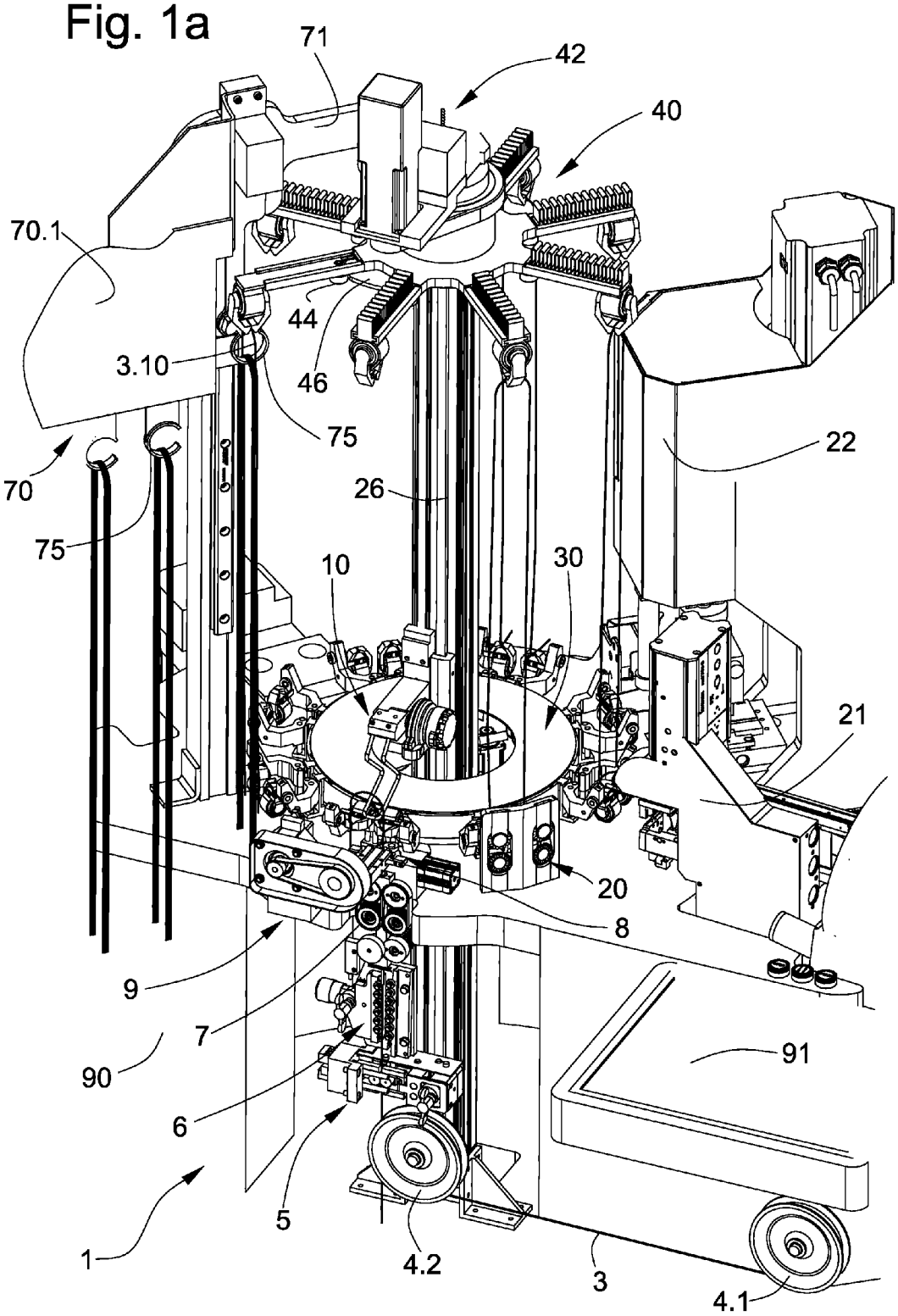
FIG. 1*a*, a cutout A1 of FIG. 1.

FIG. 1 and FIG. 1*a* show an exemplary embodiment of a device 1 for circular feeding of wire-ends to processing units 20, 21, 22, which process the wire-ends. Provided as processing units are, for example, an insulation-stripping/post-cutting station 20, a seal/sleeve module 21, and at least one crimping press 22. Up to a maximum of six further processing units can be served with wire-ends. Arranged on a frame 2 are a first diverter pulley 4.1 and a second diverter pulley 4.2, which guide a wire 3. The wire 3 is pulled from a wire stock, for example from a drum or roll, and passes through a bare-wire detector 5, and through a straightening apparatus 6, and through a belt apparatus 7, which assures the transport and the advance of the wire 3. A loop-layer 9 grasps the leading wire-end 3.1 and lays the latter in a wire-loop. The wire 3 is then advanced by the belt apparatus 7, and a loop-guide 10 picks up the loop-end and moves upward, or pulls the wire-loop out, until the wire-loop has attained the desired size and transfers the loop-end of the wire-loop to a holding element of a rotary star 40, which, by means of the loop-guide 10 and linear drive 27, is displaceable along a linear axle 26.

The processing units 20, 21, 22 are arranged peripheral to a rotary plate 30. A wire-end gripping unit 31, 32, which is arranged on the rotary plate 30, grasps the leading wire-end 3.1 and the trailing wire-end 3.2, and a wire-separating unit 8 then cuts through the wire 3. The stretched wire-loop is held tightly at the wire-ends and at the loop-end, The rotary plate 30, together with the rotary star 40, is then rotated through 45° in counterclockwise direction as viewed from above. The wire-ends 3.1, 3.2 are now in position at the insulation-stripping/post-cutting station 20 for processing. In the meantime, a further loop is formed and hung by the loop-end onto the rotary star 40 and grasped by a further wire-gripper unit 31, 32 of the rotary plate 30 at the wire-ends 3.1, 3.2. The rotary plate, together with the rotary star 40, is then rotated through a further 45° in counterclockwise direction. The wire-ends 3.1, 3.2 of the first loop are now in position at the seal/sleeve module 21 for processing, or for mounting of, for example, a sealing sleeve on the leading wire-end 3.1 and on the trailing wire-end 3.2. Simultaneously, on the insulation-stripping/post-cutting station 20, the second loop is processed. Simultaneously, a further loop is formed and hung by the loop-end onto the rotary star 40 and grasped by a further wire-gripper unit 31, 32 of the rotary plate 30 at the wire-ends 3.1, 3.2. The rotary plate, together with the rotary star 40, is then rotated through a further 45° in counterclockwise direction. The wire-ends 3.1, 3.2 of the first loop are now in position at the crimping press 22 for processing, or for mounting of, for example, a crimp contact on each wire-end 3.1, 3.2. Simultaneously, the wire-ends 3.1, 3.2 of the second loop are processed at the seal/sleeve module 21 or, for example, a sealing sleeve is mounted on the leading wire-end 3.1 and on the trailing wire-end 3.2. Simultaneously, on the insulation-stripping/post-cutting station 20, the third loop is processed. Simultaneously, a further loop is formed and hung by the loop-end onto the rotary star 40 and grasped by a further wire-gripper unit 31, 32 of the rotary plate 30 at the wire-ends 3.1, 3.2. The processing cycle now continues as described above until the first loop reaches a transporting-out device 70 to which it is transferred. The transporting-out device 70 is height-adjustable along a guiderail 60 to correspond to the height of the rotary star 40. A control 90 controls the device 1 and is connected with an input/output unit 91.

Figure 2:
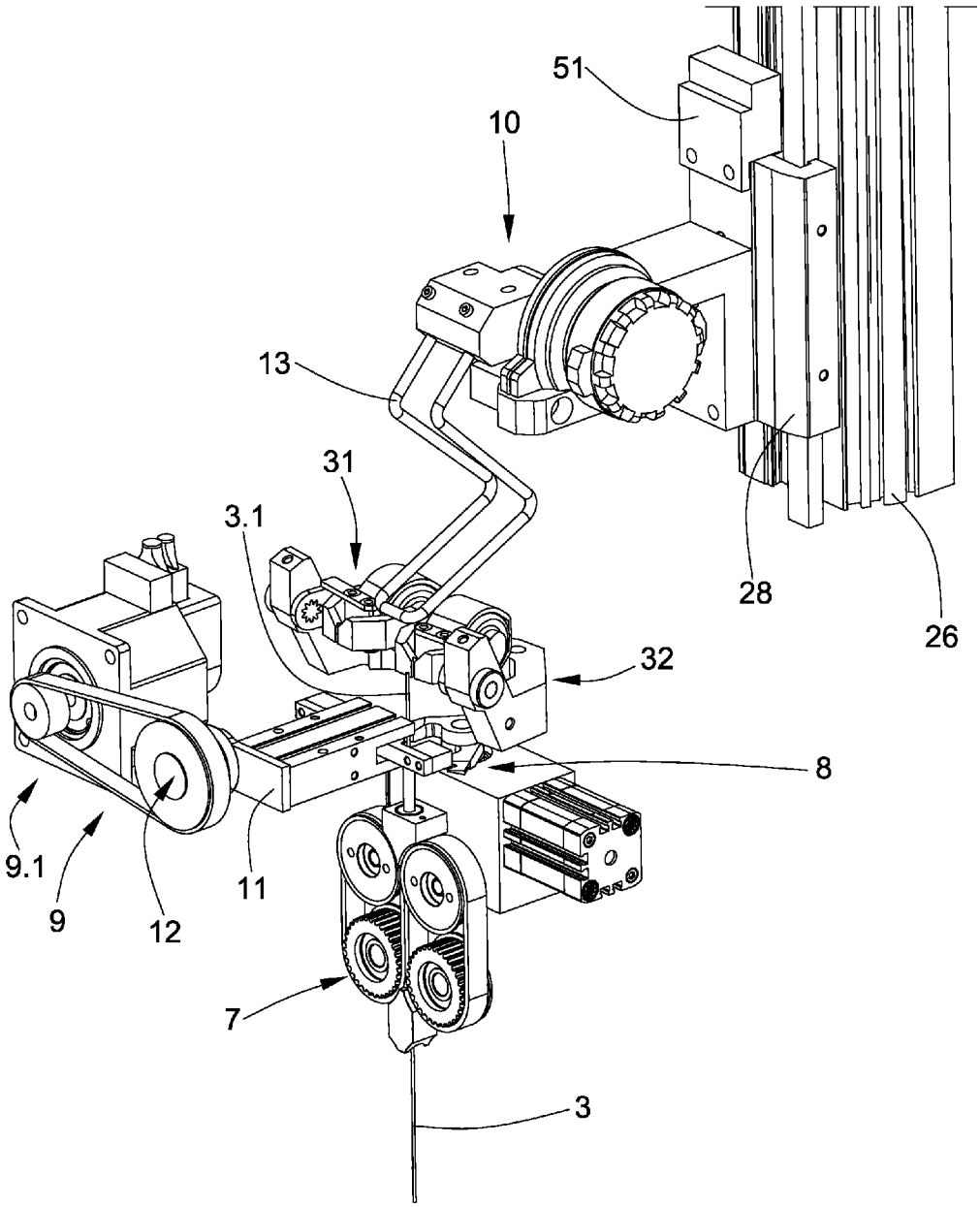
FIG. 2, FIG. 3, and FIG. 4, a wire-loop, which is being formed and transferred.

FIG. 2 shows the beginning of formation of the wire-loop. The belt apparatus 7 has advanced the wire 3 so far that a first gripper 11 of the loop-layer 9 can grasp the leading wire-end 3.1. A fork 13 of the loop-guide 10 that serves as a receptacle element for a loop-end 3.11 is ready above the wire-gripper unit 31, 32 of the rotary plate 30 to accept the loop that is to be formed.

Figure 3:
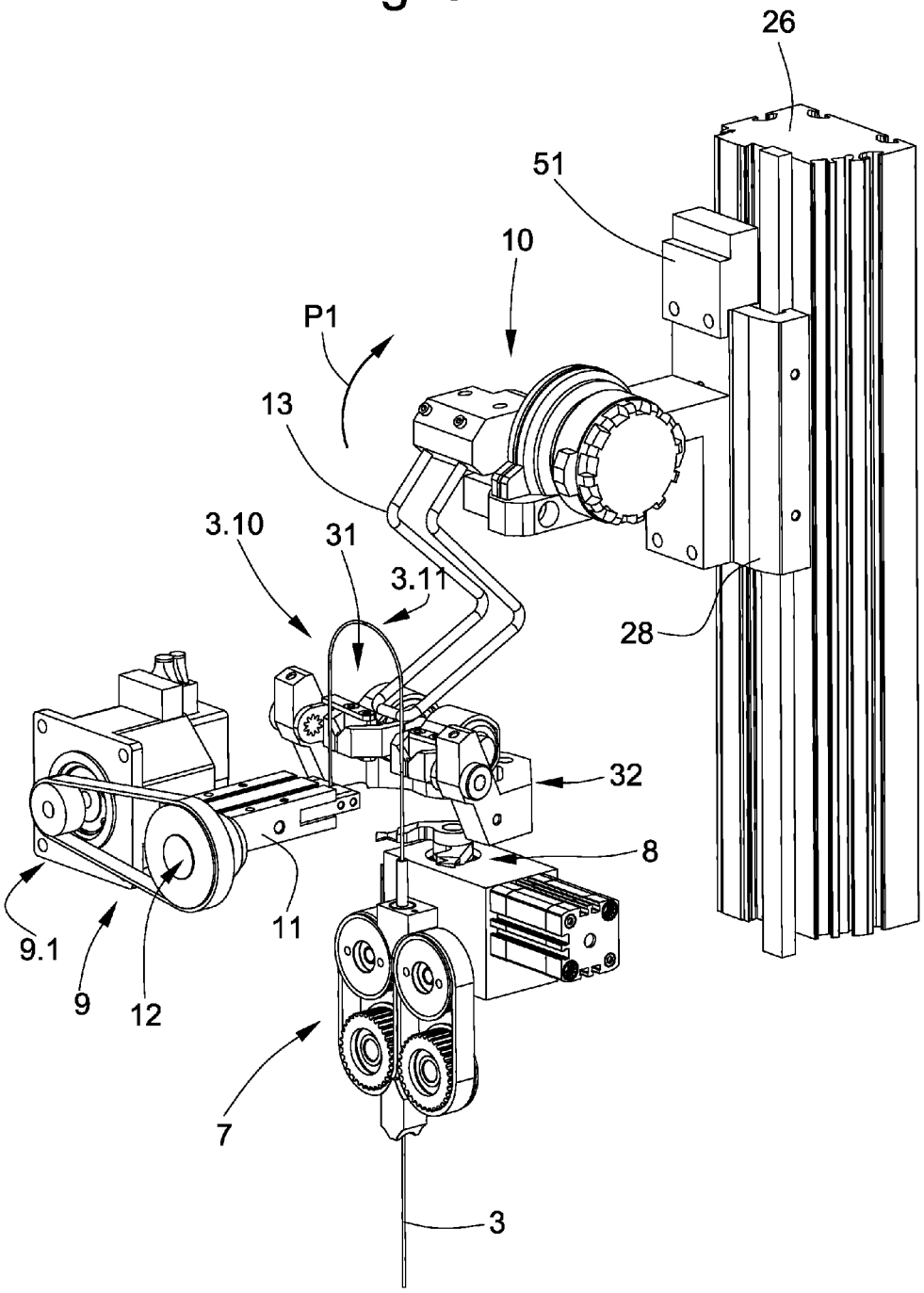

FIG. 3 shows the wire-loop 3.10 that is formed. The first gripper 11 of the loop-layer 9 has executed with the advancing wire-end 3.1 a rotation of approximately 180° in counterclockwise direction, the swivel movement being caused by a swivel-axle 12 with pulley-drive 9.1. The belt drive 7 then advances the wire 3, and the fork 13 makes a first swiveling movement P1 and accepts the loop-end 3.11. Simultaneously, and corresponding to the wire advance, the loop-guide 10 moves upward along the linear axle 26 by means of the linear-axle drive 27 until the desired loop-length is attained and the belt apparatus 7 stops. Then follows the transfer of the loop-end 3.11 to a second gripper 41 of a star-gripper unit 50, and the loop-guide 10 moves further down to accept a further loop, and with the fork 13 makes a contrary movement to the first swivel movement P1. Simultaneously, transfer of the leading wire-end 3.1 through a third gripper 33, or through a third holding element 33 of the first wire-gripper unit 31, and transfer of the trailing wire-end 3.2, through a fourth gripper 34 or through a fourth holding element 34 of the second wire-gripper unit 32. After transfer of the wire-ends 3.1, 3.2, the wire-separating unit 8 separates the wire 3 at the belt apparatus 7.

Figure 5:
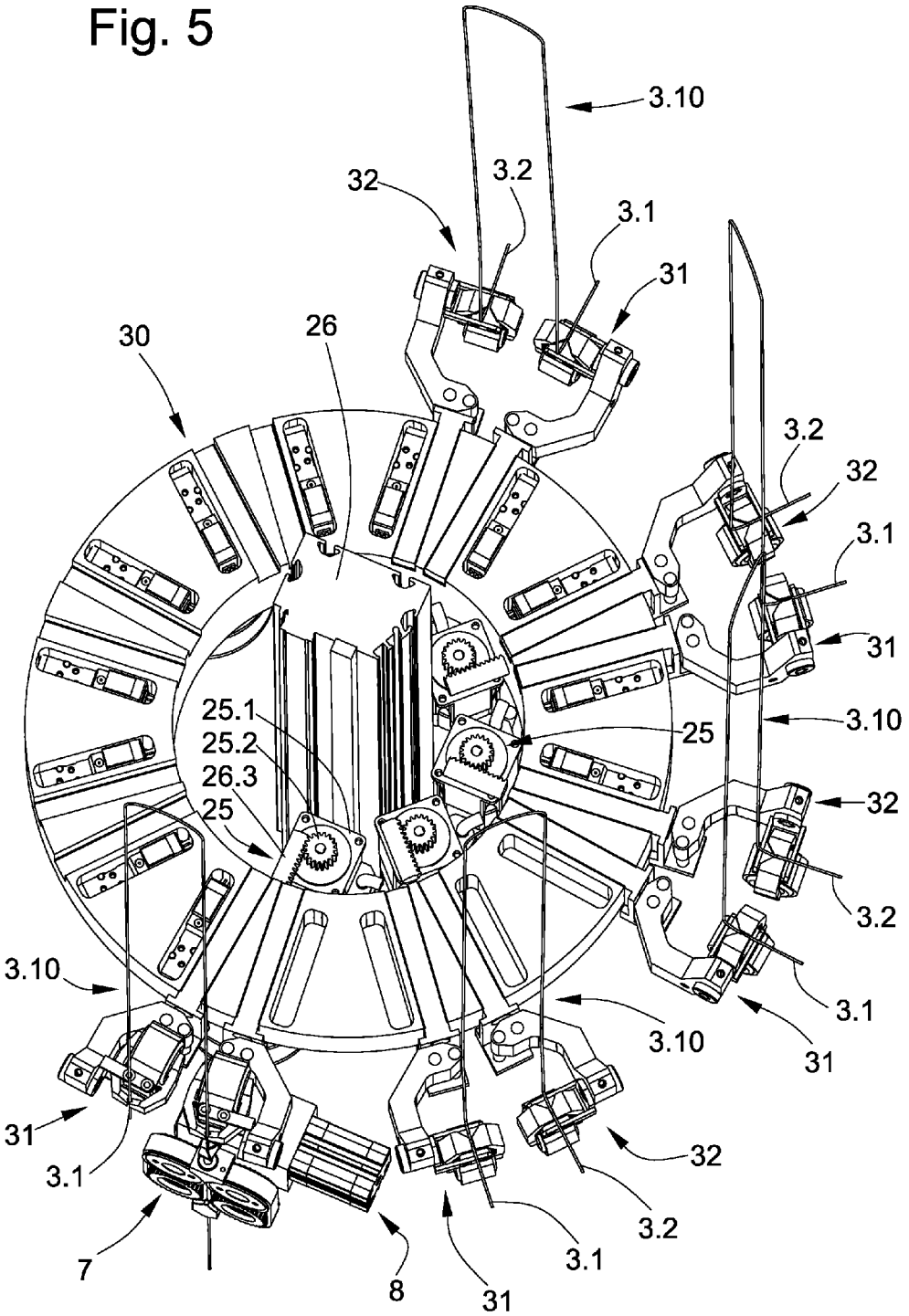
FIG. 5 and FIG. 6, a rotary plate which functions on the principle of a carousel, with wire-gripper units for feeding wire-ends to processing units.
Figure 6:
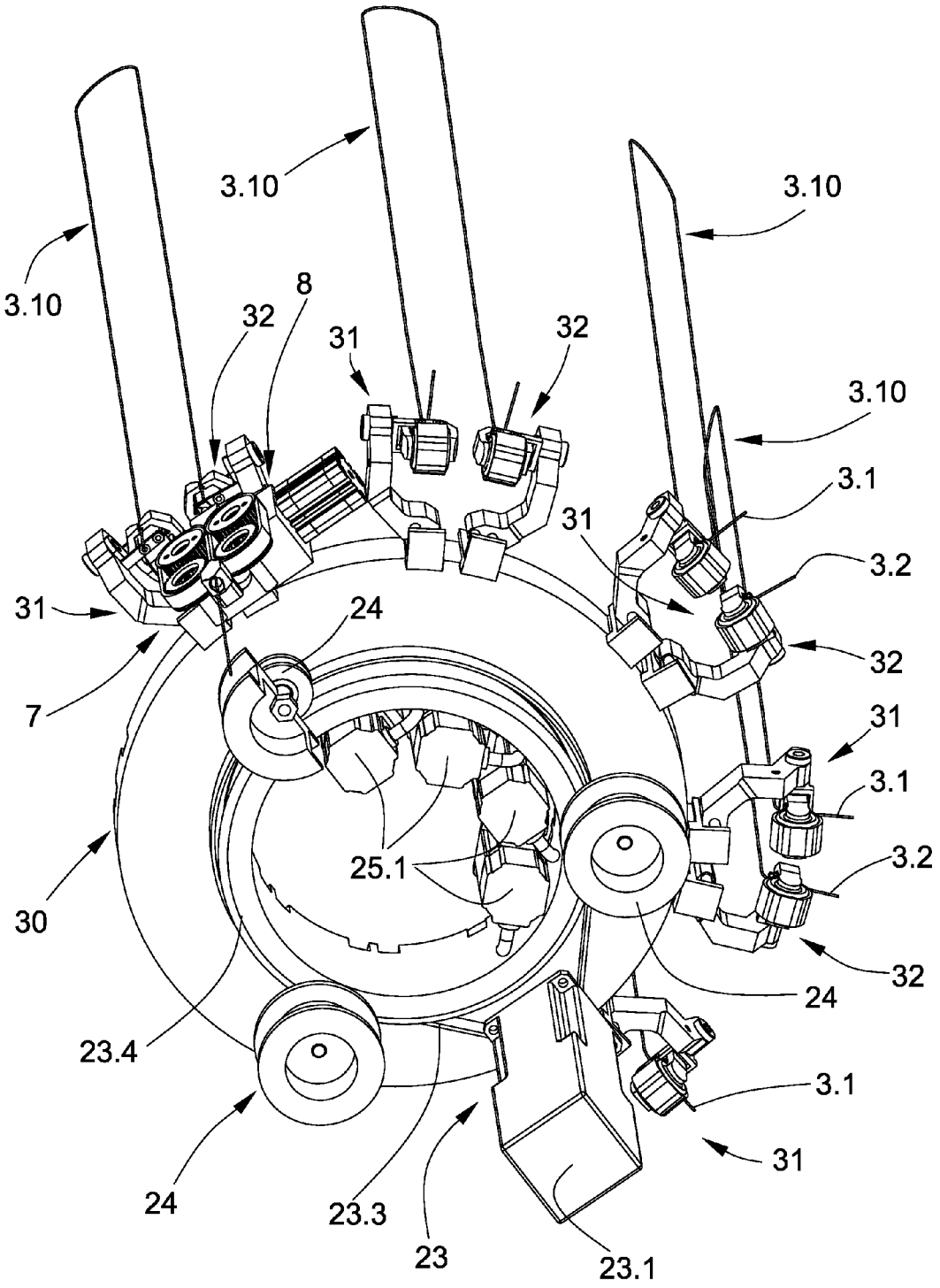

FIG. 5 and FIG. 6 show the rotary plate 30 with first and second wire-gripper units 31, 32 for feeding wire-ends 3.1, 3.2 to processing units 20, 21, 22, which functions on the principle of a carousel and occupies a horizontal plane. FIG. 5 shows a view of the rotary plate 30 from above, FIG. 6 shows a view of the rotary plate 30 from below. The rotary plate 30 provides room for eight first and eight second wire-gripper units 31, 32. A total of eight wire-loops 3.10 can thereby be held at the wire-ends 3.1, 3.2 and fed to the processing units 20, 21, 22 in 45° steps. Depending on the size of the rotary plate 30, and depending on the size of the wire-gripper units, more or fewer than eight wire-gripper units 31, 32 can be provided on the rotary plate 30. The size of the feed-steps is then more or less than 45°.

Figure 4:
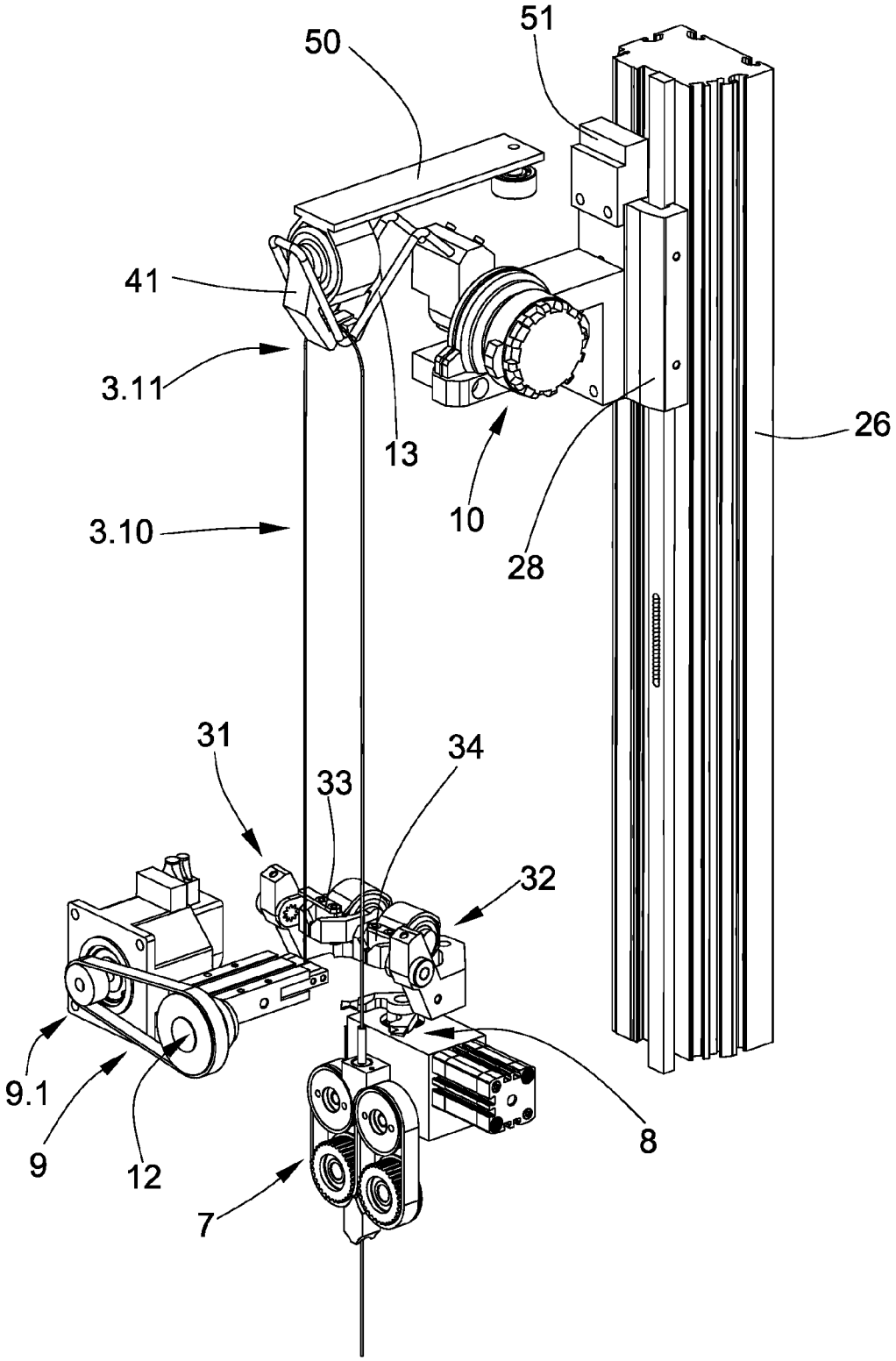

After the wire-loop 3.10 has the desired length as shown in FIG. 4, and the wire-ends 3.1, 3.2 are gripped tightly by means of the third and fourth grippers 33, 34, by means of a first setting-drive 25 the first wire-gripper unit 31 and the second wire-gripper unit 32 are brought into the feed position and the wire-gripper units 31, 32 are moved towards the rotary plate 30. As shown in FIG. 5, the first setting-drive 25 can consist of, for example, a first motor 25.1, a first pinion 25.2, and a first toothed rack 25.3 which moves the wire-gripper units 31, 32.

FIG. 6 shows the bearing rollers 24 that bear a rotary plate 30 which occupies a horizontal plane. The rotary plate 30 is driven by a second setting-drive 23, consisting of, for example, a second motor 23.1, a not-visible second pulley, which, by means of a second belt 23.3, drives a second belt-sheave 23.4 of the rotary plate 30. Instead of the belt and the belt-sheave, other drive means are also possible. In each case, the second motor 23.1 turns the rotary plate 30 by the aforesaid 45° in counterclockwise direction as viewed from above.

Figure 7:
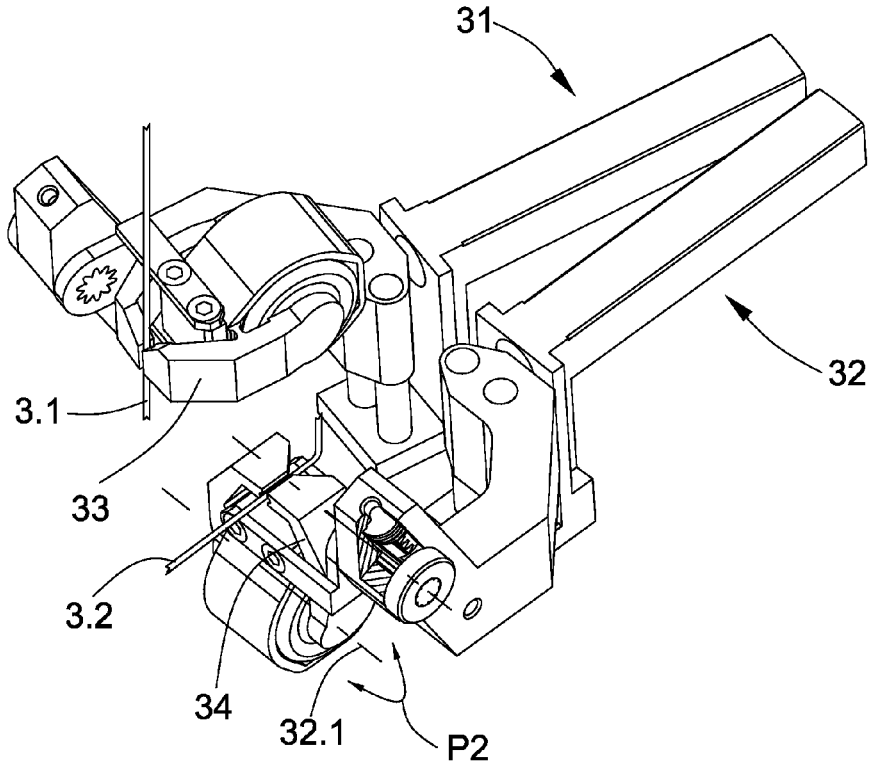
FIG. 7, details of a wire-gripper unit with grippers for tightly holding wire-ends.

FIG. 7 shows details of the first wire-gripper unit 31 with the third gripper 33 and of the second wire-gripper unit 32 with the fourth gripper 34. The third gripper 33 of the first wire-gripper unit 31 is shown in the position after gripping the advancing wire-end 3.1. The advancing wire-end 3.1 runs vertically.

The fourth gripper 34 of the second wire-gripper unit 32 is in the position after gripping the trailing wire-end 3.2 and after swiveling of the fourth gripper by 90°. The trailing wire-end 3.2 runs horizontally and the wire 3 of the wire-loop 3.10 still runs vertically. In the horizontal position, the trailing wire-end 3.2 is ready for feeding and for processing in the processing units 20, 21, 22. The fourth gripper 34 is swivelable about a first axis 32.1 by approximately 90°. The swivel movement is symbolized with a second arrow P2. The swivel movement can be executed by means of, for example, a pneumatic drive. This similarly applies for the first gripper 33.

Figure 8:
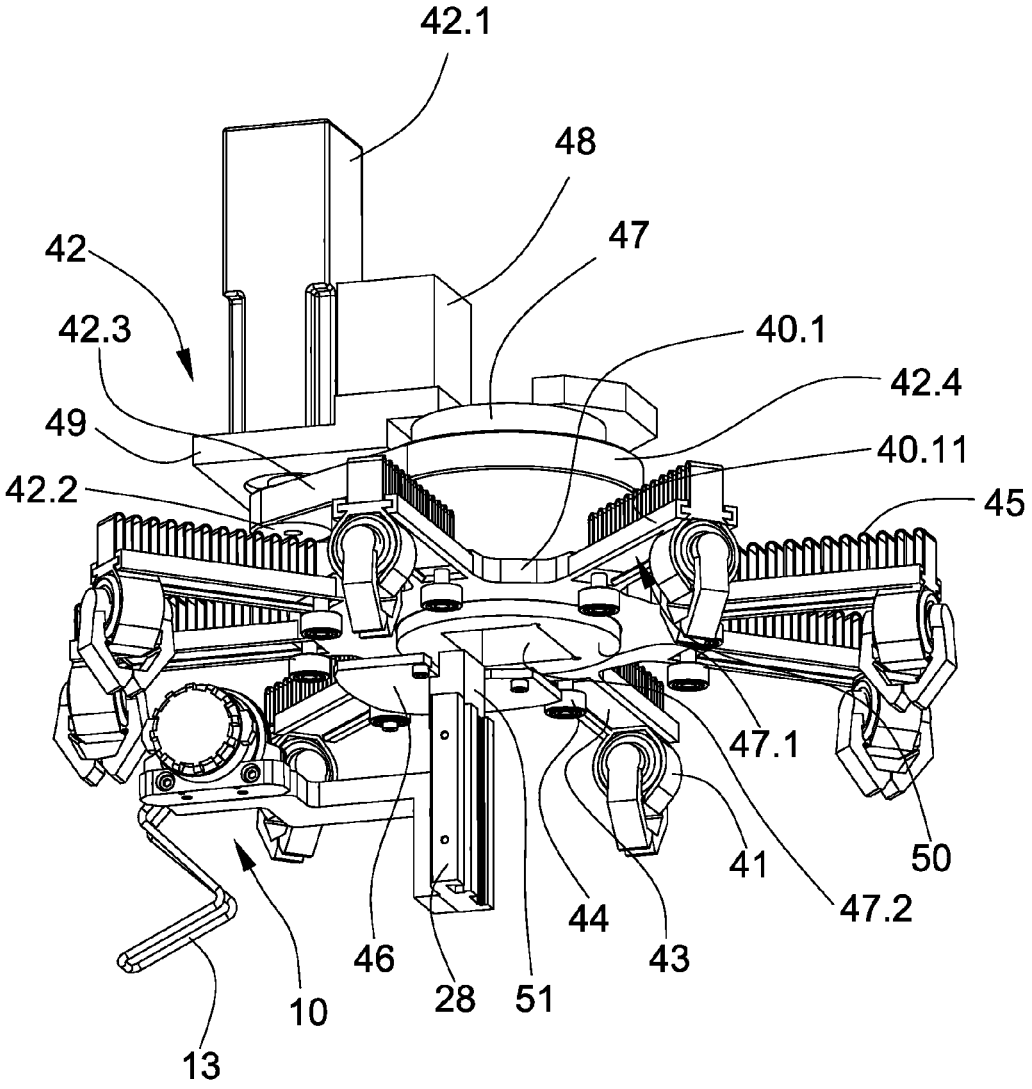
FIG. 8, details of a rotary star with star-gripper units for holding a wire-loop.

FIG. 8 shows details of the rotary star 40 with star-gripper units 50 to hold wire-loops 3.10. The rotary star 40 consists of a third setting-drive 42 with a third motor 42.1, a third pulley 42.2, a third belt, and a third belt-sheave 42.4. Instead of the belt and the belt-sheave, other drive means are also possible. The rotary star 40 further consists of an eight-armed star housing 40.1, which is mounted rotatably on a bush 47 with connector 47.1, and is drivable by means of the third setting-drive 42. By means of a first plate 49, the bush 47 is connected with the third motor 42.1 and with a locking unit 48 and is provided with an opening 47.2, through which the linear axle 26 runs, the bush 47 being displaceable along the linear axle 26. Along the linear axle 26, the rotary star 40 is moved by means of the loop-guide 10. Depending on the length of the wire-loops 3.10 that are to be formed, by means of a pressure piece 51 that acts on the connector 47.1, the loop-guide 10 pushes the rotary star 40 in upward direction or lowers the rotary star 40 along the linear guide 26. For this purpose, the locking unit 48 releases the bush 47 from the linear axle 26 and, after the position of the rotary star 40 is reached, locks the locking unit 48 again in the bush 47 on the linear axle 26.

Figure 9:
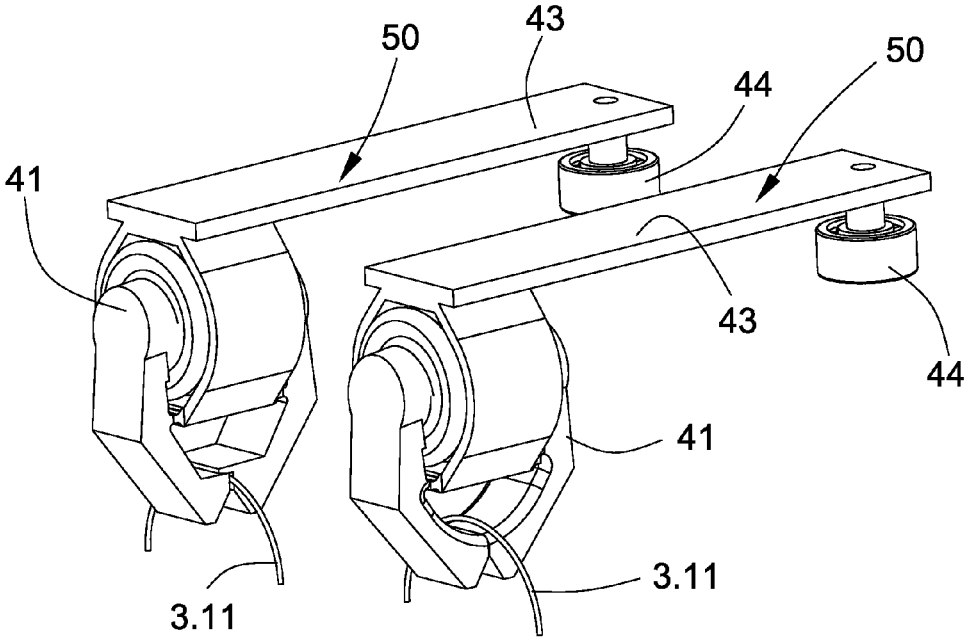
FIG. 9, details of a star-gripper unit.

Further provided is a coulisse 46 which is arranged on the connector 47.1, which controls the overhang of the star-gripper units 50. As shown in FIG. 9, each star-gripper unit 50 consists of a first plate 43, at one end of which a first roller 44, and at the other end of which a fifth gripper 41, or a fifth holding element 41, is arranged. The fifth gripper 41 can grip (FIG. 9, left drawing) or guide (FIG. 9, right drawing) the loop-end 3.11. Each first plate 43 is borne movably on a first arm 40.11 of the star housing 40.1. On turning of the star housing 40.1, in the area of the loop transfer to the transporting-out device 70, the first roller 44 rolls off the coulisse 46. The coulisse 46 pushes the first roller 44, and thereby the first plate 43, against the spring-force of a first spring 45 out and away from the linear axle 26, until the position of the fifth gripper 41 to transfer the loop to the transporting-out device 70 is reached. On further turning of the star housing 40.1 in counterclockwise direction (viewed from above), the first spring 45 pushes the first plate 43 back into its starting position.

In each case, the star housing 40.1 that occupies a horizontal plane is turned synchronously with the rotary plate 30 by 45°. In the case of a rotary plate 30 with more or fewer than eight first and second wire-gripper units 31, 32, the star housing 40.1 also has more or fewer than eight arms 40.11, the wire-gripper units 31, 32 and the star housing being in each case turned further by less or more than 45°.

FIG. 1 and FIG. 1*a* show the transporting-out device 70, to which the completely processed wire-loops 3.10 are transferred from the rotary star 30. The transporting-out device 70 consists essentially of a blade 70.1 with a diverter pulley arranged at each end of the blade 70.1. Guided by the diverter pulleys is an endless belt, or an endless chain, with hangers 75, wherein the one diverter pulley is drivable by means of a drive. By comparison with a chainsaw, the blade, endless belt or endless chain, and drive are provided with hangers 75 instead of chain teeth. Provided on the blade 70.1 is a sliding guide, which guides the blade 70.1 along the guiderail 60. In vertical direction, the blade 70.1 is moved by the rotary star 40, an angle arm 71 loosely connecting the blade 70.1 with the rotary star 40. The completely processed wire-loops 3.10 are removed, for example manually, from the transporting-out device 70.

FIG. 1*a* shows how a wire-loop 3.10 that is completely processed at the wire-ends is transferred from the rotary star 30 to a hanger 75. The hanger 75 can accommodate a plurality of wire-loops, for example all wire-loops of a production lot. In the case of the transferring first arm 40.11, in the interest of better understanding of the means of functioning of the enlarged overhang of the star-gripper unit 50, the first spring 45 is not shown.

Figure 10:
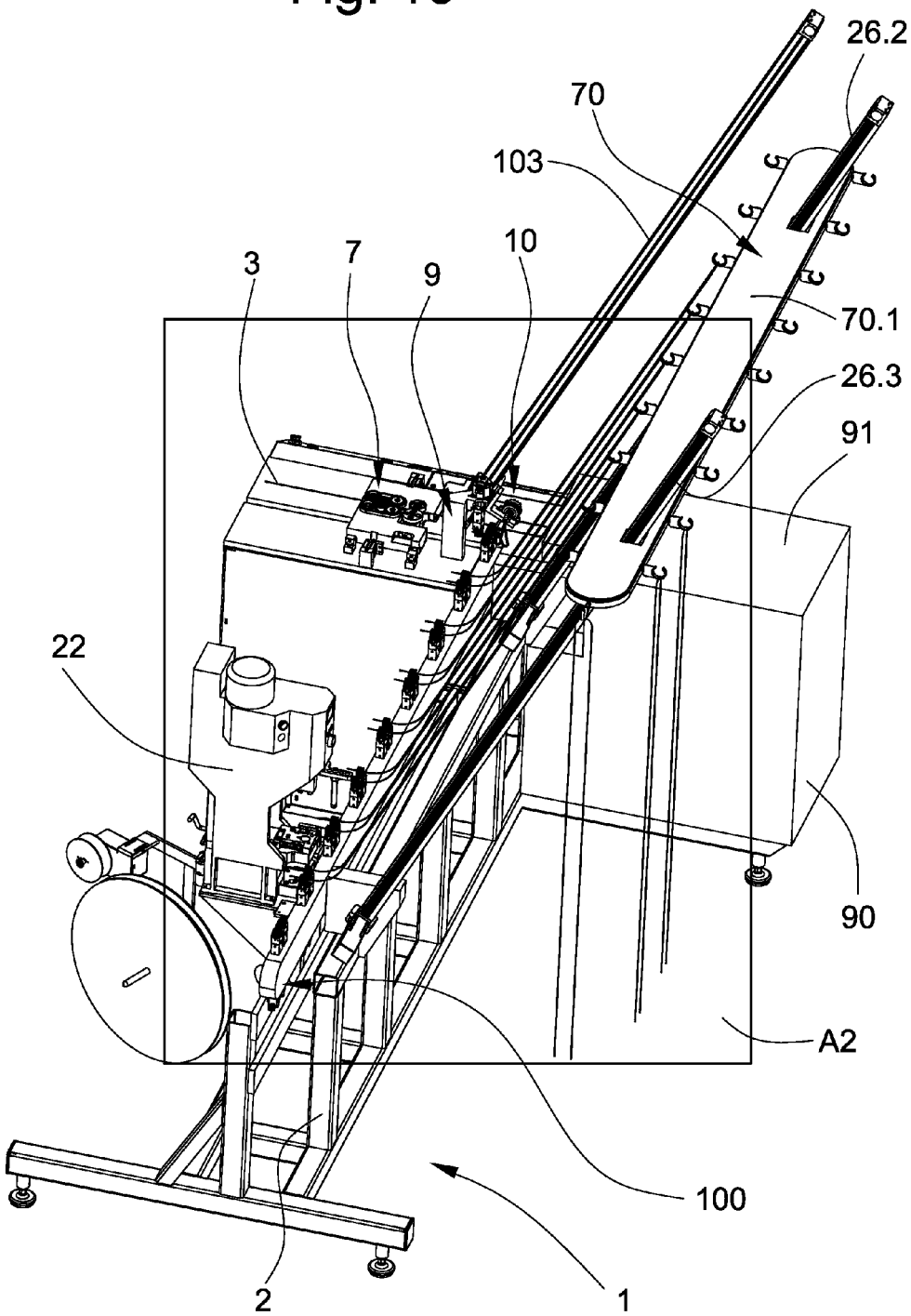
FIG. 10, a variant embodiment of the device for feeding wire-ends to processing units.
Figure 10A:
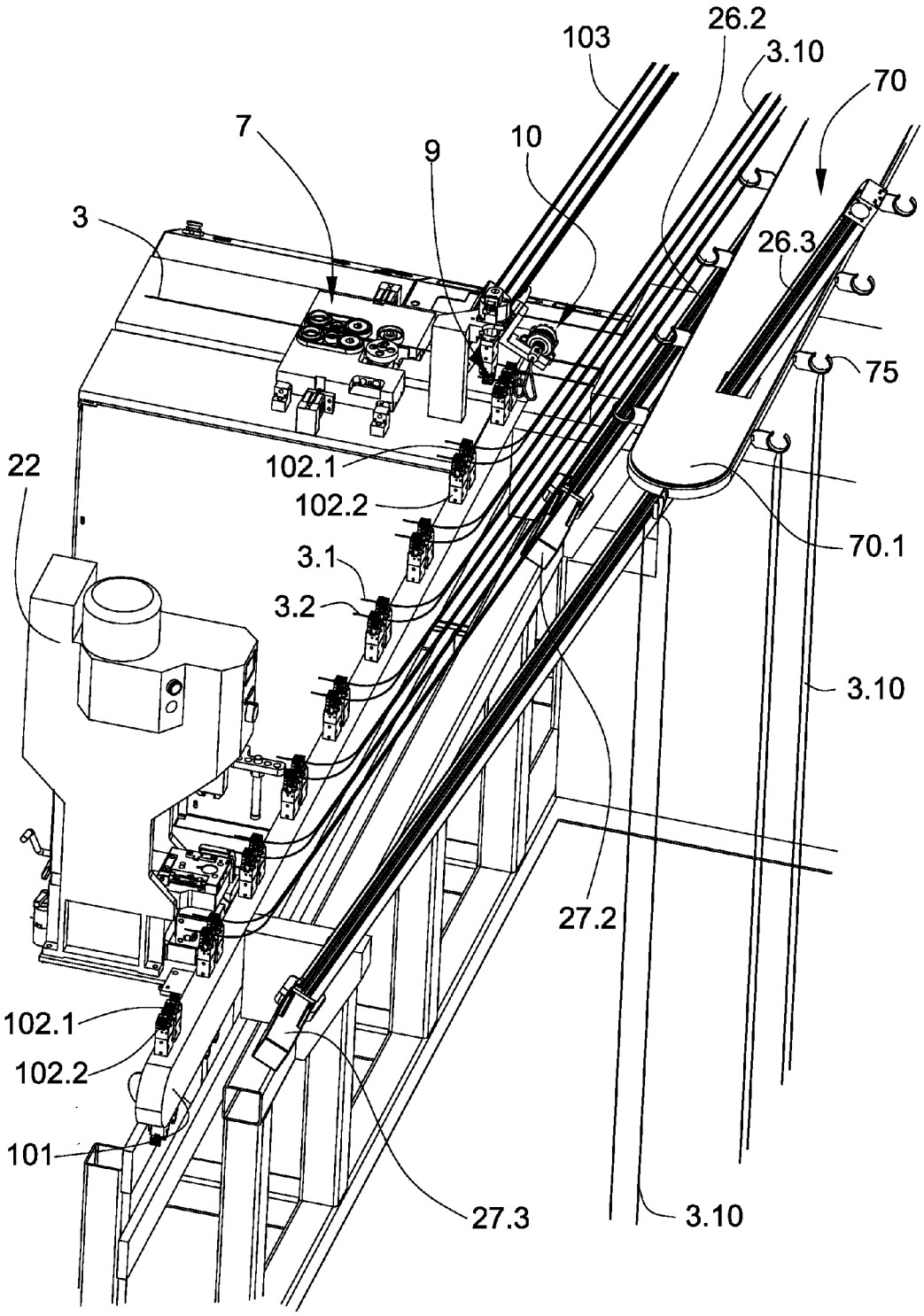
FIG. 10*a*, a cutout A2 of FIG. 10.

FIG. 10 and FIG. 10*a* show a variant embodiment of the device for feeding wire-ends 3.1, 3.2 to processing units, as, for example, a wire-stripping/post-cutting station 20, a seal/sleeve module 21, and at least one crimping press 22. For greater clarity, in FIG. 10 and FIG. 10*a* of the processing units, only a crimping press 22 is shown. The processing units are arranged in sequence, which necessitates sequential feeding of the wire-ends 3.1, 3.2, to the processing units. Provided for this purpose along the processing units is a sequential transport device 100 which is arranged on the frame 2, which is embodied as an endless belt 101 (also possible is an endless chain), there being arranged on the endless belt sixth grippers 102.1, 102.2. The sixth grippers 102.1, 102.2 are arranged in pairs on the endless belt 101, the distance from gripper pair to gripper pair corresponding to the distance from processing point to processing point of the processing units. The one sixth gripper 102.1 of the gripper pair holds the leading wire-end 3.1 tightly and the other sixth gripper 102.2 of the gripper pair holds the trailing wire-end 3.2 tightly. The one gripper 102.1 accepts the leading wire-end 3.1 from the loop-layer 9 and the other gripper 102.2 accepts the trailing wire-end 3.2 from the not-visible wire-separating unit after advance of the desired wire-length 3 by means of the belt apparatus 7. After the loop-layer 9 has formed the loop-end 3.11, the loop-guide 10 accepts the loop-end 3.11 and pulls the wire-loop 3.10 out, or brings the loop-end along a diagonally placed fourth linear axle 103 of the transporting-out device 70. The belt apparatus 7 thereby pushes the wire 3 forward until the loop-end 3.11 has arrived at the transporting-out device 70 and the wire-loop 3.10 has attained the desired length. Depending on the length of the wire-loop 3.10, the transporting-out device 70 is displaceable along a second linear axle 26.2 and along a third linear axle 26.3 by means of linear-axle drives 27.2, 27.3. Otherwise, the construction of the transporting-out device 70 is comparable with the transporting-out device 70 of FIG. 1 and FIG. *a*, with the difference that the blade 70.1 is aligned horizontally. The control 90 controls the device 1 and is connected with the input/output unit 91.

Figure 11:
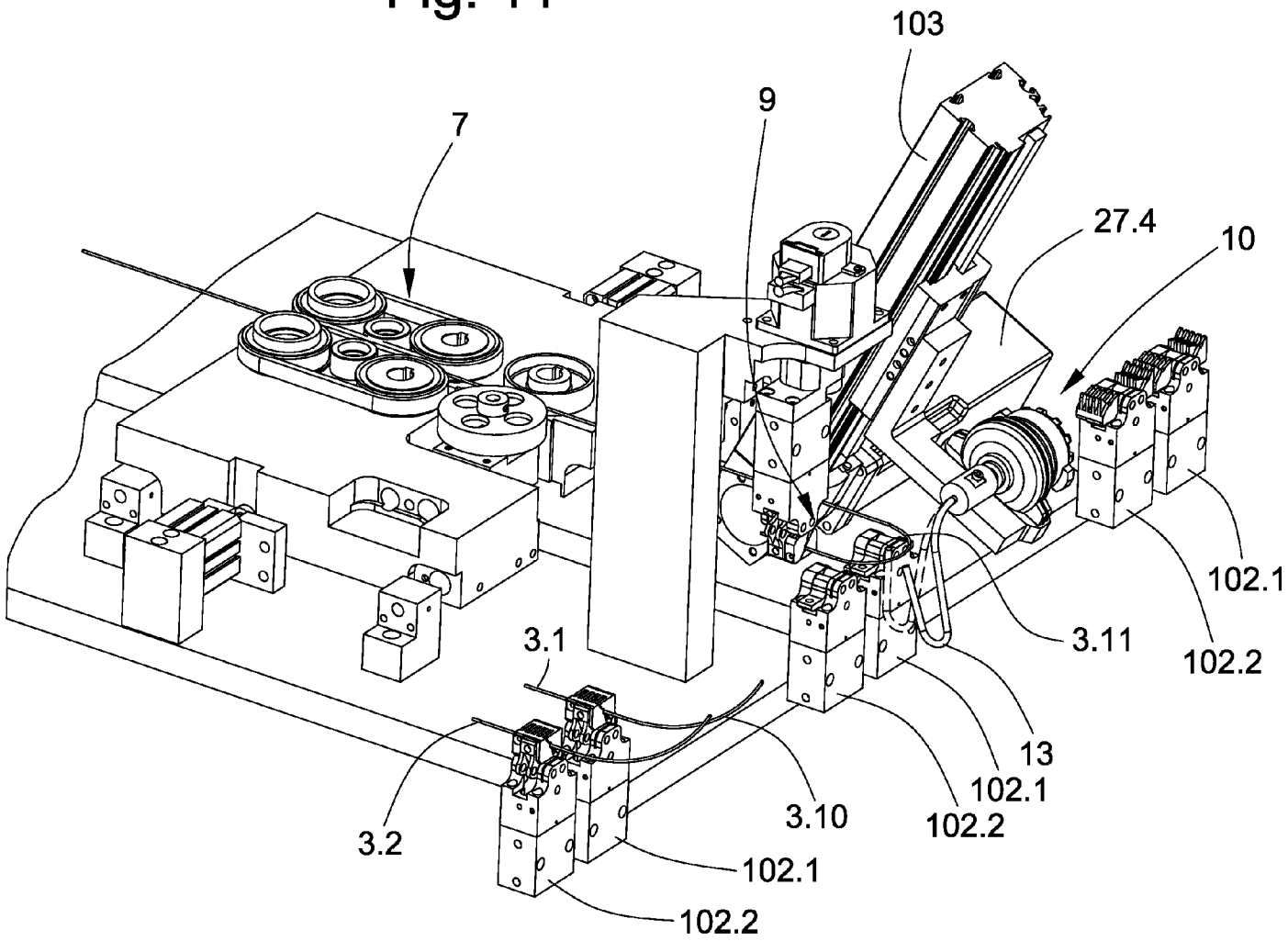
FIG. 11, details of the loop formation, transfer of a loop-end, and transfer of the wire-ends.

FIG. 11 shows details of the loop formation by means of the loop-layer 9, details of the transfer of the loop-end 3.11 by means of the loop-guide 10, and details of the transfer of the wire-ends 3.1, 3.2 by means of the sixth grippers 102.1, 102.2. Gripper jaws of the loop-layer 9 hold the leading wire-end 3.1 tightly and execute a rotating movement through 180° in a horizontal plane. Simultaneously, the belt apparatus 7 advances the wire 3. After the rotating movement through 180°, the wire-loop 3.10 is embodied as shown in FIG. 11 and can be accepted by the fork 13 of the loop-guide 10. The fork 13 thereby executes a swiveling movement and arrives at the position that is shown with a continuous line. By means of the fourth linear axle drive 27.4, the loop-guide 10 is then moved diagonally upward along the fourth linear axle 103, the fork 13 entraining the wire-loop 3.10 by the loop-end 3.11. As long as the loop-guide 10 is traveling upward, the belt apparatus 7 pushes the wire 3 forward until the desired length of the wire-loop 3.10 is attained. A pair of sixth grippers 102.1,

102.2 then accepts the leading wire-end 3.1 and the trailing wire-end 3.2, and the wire-separator unit separates the trailing wire-end 3.2 from the wire 3. In the interest of greater clarity, in FIG. 11 the pair of sixth grippers 102.1, 102.2 is shown without gripper jaws.

Figure 12A:
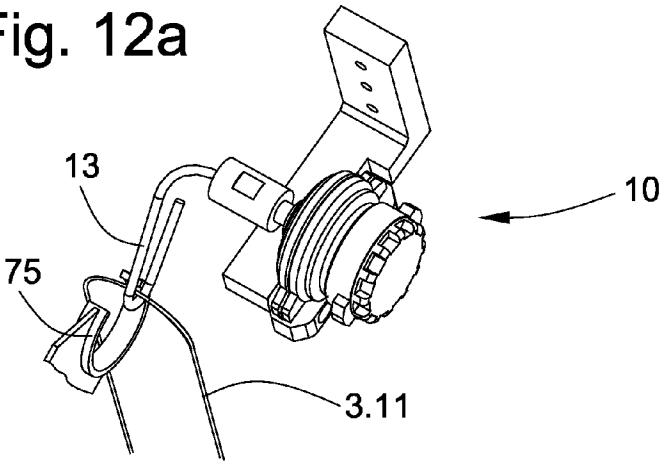
FIG. 12 and FIG. 12*a*, details of transfer of the loop-end to a transporting-out device.
Figure 12:
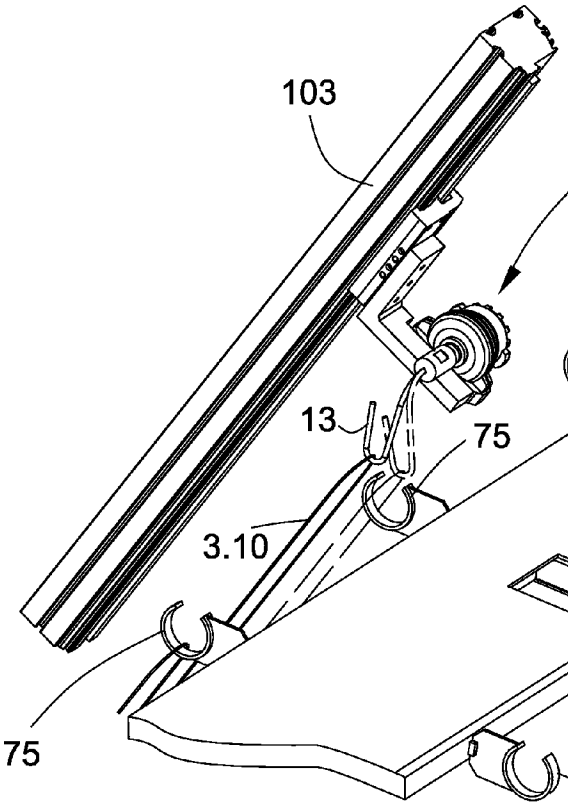

FIG. 12 and FIG. 12*a* show details of the transfer of the loop-end 3.11 to a hanger 75 of the transporting-out device 70. Therein, the fork 13, which serves as a hanger element, executes a swiveling movement and arrives at the position that is shown with a continuous line. Visible in FIG. 12*a* is that the fork 13 of the loop-guide 10 is arranged above the hanger 75 and slightly offset relative to the hanger 75. The loop-guide 10 is now moved downward and the loop-end 3.11 remains hanging on the hanger 75. The wire-loop 3.10 is now held tightly at three points and stretched and, for sequential feeding of the wire-ends 3.1, 3.2 to the processing units, the sequential transport device 100, together with the transporting-out device 70, can be moved further by one unit, one unit corresponding to the distance from processing point to processing point of the processing units. The completely processed wire-loops 3.10 are removed, for example manually, from the transporting-out device 70.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An apparatus for feeding wire ends of a wire loop to a processing unit, the apparatus comprising:

a first holding element for holding a leading wire end of the wire loop;

a second holding element for holding a trailing wire end of the wire loop;

a third holding element for holding a loop end of the wire loop, the wire loop being stretched between the first, second and third holding elements when the wire loop is held by the apparatus; and the first holding element comprising a first gripper for the leading wire end, the first holding element being part of a first wire-gripper unit, the second holding element comprising a second gripper for the trailing wire end, the second holding element being part of a second wire-gripper unit, the first and second wire-gripper units being arranged on a rotary plate, the processing unit being arranged peripheral to the rotary plate.

2. The apparatus of claim 1, the third holding element being movable together with the first and second holding elements while feeding the wire ends to the processing unit.

3. The apparatus of claim 1, a movability of the third holding element depending on a length of the wire loop.

4. The apparatus of claim 1, further comprising a loop guide with a hanger element, the hanger element being configured to receive the loop end of the wire loop, to pull the wire loop out, and to transfer the wire loop to the third holding element.

5. The apparatus of claim 1, the first and second wire-gripper units being displaceable in a radial direction relative to the rotary plate, the gripper for the leading wire end and the gripper for the trailing wire end each being swivelable by approximately 90 degrees about an axis to create a swivel movement, the swivel movement moving the wire ends of the wire loop from a vertical alignment into a horizontal alignment.

6. A method comprising:

laying a wire loop from a wire stock;

accepting the wire loop at a loop end of the wire loop;

stretching the wire loop to a desired length;

tightly holding a leading wire end of the wire loop using a first holding element;

tightly holding a trailing wire end of the wire loop using a second holding element;

transferring the loop end to a third holding element;

separating the wire loop from the wire stock; and feeding the leading wire end and the trailing wire end to a processing unit using a feeding movement, the loop end following the feeding movement and remaining stretched during the feeding movement.

7. The method of claim 6, the feeding movement progressing circularly.

8. The method of claim 6, the feeding movement being correct for the processing unit.

9. An apparatus for feeding wire ends of a wire loop to a processing unit, the apparatus comprising:

a first holding element for holding a leading wire end of the wire loop;

a second holding element for holding a trailing wire end of the wire loop;

a third holding element for holding a loop end of the wire loop, the wire loop being stretched between the first, second and third holding elements when the wire loop is held by the apparatus; and the third holding element comprising a gripper, the third holding element being coupled to an arm of a rotary star, the rotary star being vertically displaceable relative to a rotary plate.

10. The apparatus of claim 9, further comprising a displaceable loop guide with a hanger element, the hanger element being configured to transfer the loop end of the wire loop to the third holding element.

11. An apparatus for feeding wire ends of a wire loop to a processing unit, the apparatus comprising:

a first holding element for holding a leading wire end of the wire loop;

a second holding element for holding a trailing wire end of the wire loop;

a third holding element for holding a loop end of the wire loop, the wire loop being stretched between the first, second and third holding elements when the wire loop is held by the apparatus; and the first holding element comprising a first gripper and being part of an endless belt, the second holding element comprising a second gripper and being part of the endless belt, the processing unit being one of a plurality of processing units, the processing units being arranged along the endless belt.

12. The apparatus of claim 11, further comprising a displaceable wire guide with a hanger element, the hanger element being configured to transfer the loop end of the wire loop to a holding element of a transporting-out device, the holding element of the transporting-out device being simultaneously movable with the first and second holding elements.

* * * * *